US005709374A

United States Patent [19]

Taylor et al.

[11] Patent Number: 5,709,374

[45] Date of Patent: *Jan. 20, 1998

[54] SYSTEM FOR AUTOMATIC PRINT JOBS SEPARATIONS IN CONTAINER WITH VERTICALLY PROJECTING FOLDERS

[75] Inventors: Thomas N. Taylor, Rochester; Robert A. Panos, Penfield; Sudarshan S. Bains, Pittsford, all of N.Y.

[73] Assignee: Xerox Corporation, Stamford, Conn.

[ * ] Notice: The term of this patent shall not extend beyond the expiration date of Pat. No. 5,704,602.

[21] Appl. No.: 732,760

[22] Filed: Oct. 18, 1996

[51] Int. Cl.[6] ..... B41F 13/54; B65H 39/02

[52] U.S. Cl. ..... 270/1.02; 270/45; 270/52.03; 270/58.32

[58] Field of Search ..... 270/1.01, 1.02, 270/45, 52.03, 58.07, 58.14, 58.31, 58.32

[56] References Cited

U.S. PATENT DOCUMENTS

| | | | |
|---|---|---|---|
| 5,031,891 | 7/1991 | Kobler et al. | 270/52.03 |
| 5,085,417 | 2/1992 | Copham | 270/1.02 |
| 5,207,412 | 5/1993 | Coons, Jr. et al. | 270/1.1 |
| 5,316,279 | 5/1994 | Corona et al. | 270/1.1 |
| 5,377,965 | 1/1995 | Mandel et al. | 270/1.1 |
| 5,519,624 | 5/1996 | Hidding | 270/52.03 X |
| 5,547,178 | 8/1996 | Costello | 270/52.02 |

FOREIGN PATENT DOCUMENTS 0547788 1/1993 European Pat. Off. .

*Primary Examiner*—Hoang Nguyen

[57] ABSTRACT

In reproduction systems in which a printer outputs a plurality of different plural sheet print jobs, a system is provided for automatically separating respective print jobs into separate specially formed folders for respective print jobs and stacking a number of them into one or more specially shaped print jobs stacking containers, with the closed folders formed to extend above and provide clear distinctions and separations of their respective print jobs in the container so that a selected print job can be readily removed as a unit from the container. The folders may be on-line separately printed in tab areas and folded. The folding can be uneven or skewed or otherwise formed to be held above their contained print jobs even if the folder was from the same size paper stock.

5 Claims, 9 Drawing Sheets

Figure 1:
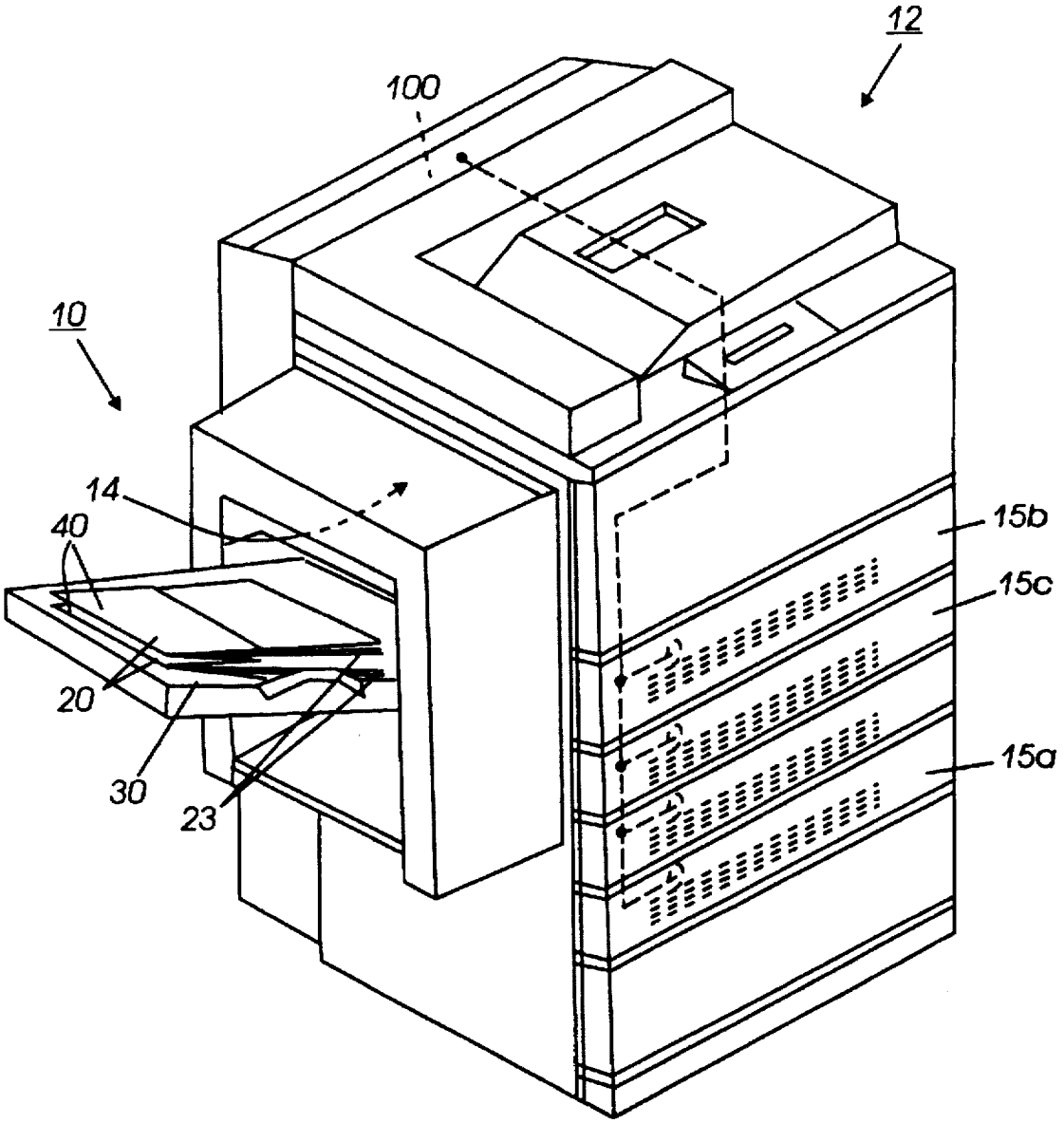

SYSTEM FOR AUTOMATIC PRINT JOBS SEPARATIONS IN CONTAINER WITH VERTICALLY PROJECTING FOLDERS

Cross-reference is made to a copending application by the same assignee, with inventors in common, filed on the same date, as U.S. application Ser. No. 08/732,759, entitled "System for Automatic Print Jobs Separations in Folders", Attorney Docket No. D/96436.

There is disclosed a system for improved separation and distinction of the print jobs output of a printer, especially useful for distinguishing between the print jobs of different users stacked in a common output container for the output of a plural shared users network printer. Disclosed hereinbelow is a system for automatic generation of special banner sheet folders for respective print jobs, which folders remain partially extended above their enclosed print jobs even when vertically oriented, for providing clear distinctions and separations of respective print jobs, and automatic wrapping and/or insertion of the respective print job sheets into these automatically generated banner sheet folders, on-line at the printer output, and a special container for plural such print job folders which increases their separation, identification, and ease of removal of selected individual print jobs.

In reproduction apparatus such as xerographic and other copiers and printers or multifunction machines, it is increasingly important to provide faster yet more reliable and more automatic handling of the physical image bearing sheets. Shared user network printers can provide faster, more reliable, and more featured printing at lower costs per page than small individual desk printers, but have greater need for job separations.

It is known to automatically print identifying and separating "banner sheets" for the respective print jobs in electronic printers with shared users. A banner sheet is typically automatically printed by the printer with job and user identifying indicia and automatically inserted before or after the printing of the first or last sheets of each print job to provide job or set distinguishing and user identifying printed indicia, preferably visible from the top of the stack of sheets comprising the print job. Of particular interest is Xerox Corp. U.S. Pat. No. 5,316,279 (D/92217) issued May 31, 1994, by S. C. Corona, E. Fox and N. Robinson, which discloses banner cover sheets which can be rotated by 90 degrees or be printed on larger sheets relative to their respective print jobs so as to partially extend from the print jobs with printed indicia areas for ease of job identification and separation. As is described in said U.S. Pat. No. 5,316,279, and other art cited therein and elsewhere, such banner sheets were heretofore provided primarily as job separator sheets for commonly stacked (commingled) print jobs, especially of different users. However, such banner sheets can be obscured in common plural job stacks, and do not provide fully adequate print job separations. The automatic generation of such printed banner sheets in a printer is well known per se from these and other references, including Xerox Corp. U.S. Pat. No. 5,547,178 issued Aug. 20, 1996 (D/95012), as will be further noted below, and need not be described in detail herein.

It is also known, from patents cited herein and otherwise, to provide lateral or process direction offsetting, or partially skewed offsetting, of alternate superposed print job sets at a common output stacking tray, finished or unfinished, with or without printed job identifying cover or "banner" sheets. It is also well known to offset the banner sheets laterally relative to its respective underlying print job sheets, or to offset alternate print jobs and their banner sheets, e.g., simply by reciprocating the output tray or the output rollers laterally between two laterally offset positions. E.g., U.S. Pat. Nos. 4,480,825; 4,712,786; 4,157,059; 4,188,025; 4,318,539; 4,858,909; 4,861,213; 5,007,625; 5,188,353; 5,037,081; and 4,688,924. Accordingly, such systems need not be described in detail herein. However, offsetting per se is often not effective to prevent job comingling or inadvertent removal by users of jobs of other users of the printer, especially since partial removal of some sets from a stack, or additional ejected sets, can skew or scramble the stack.

In addition to art on what are called "banner sheets" for printer jobs, it is also well known to provide copiers with automatic cover sheets and other inter-sets or intra-sets sheet inserts, with or without printing thereon, automatically fed and inserted by the machine controller to arrive at the common output at the correct time and location in coordination with the printing of their respective print jobs or document sets, either from selectable conventional internal paper trays or external inserting systems. Some examples include Xerox Corp. U.S. Pat. Nos. 4,536,078; 5,207,412; 5,272,511; 5,489,969; 4,602,776 and Eastman Kodak U.S. Pat. Nos. 4,602,775; and 4,763,161. Accordingly, such systems need not be described in detail herein.

Also of interest regarding print job separation and identification systems is a Xerox Corp. Jun. 23, 1993 published EPO application No. 0 547 788 A1 of Murray O. Meetze, D/91042K EP, on a system of applying small removable adhesive edge wrap tapes around opposite sides of a print job set, which may have readable bar codes or the like on the exposed areas of the tapes at the job set edges or otherwise. That system, of course, requires a separate supply of such tape material, a tape printer, and a sets taping system or applicator, and subsequent removal of the tapes. On-line sets finishing by binding and/or stapling together the sheets of each print job set is also well known, but has similar disadvantages, plus re-separating the fastened sheets can leave them bent, marked, apertured or damaged. It is often desired to have lose (unfastened or unbound) sheets, such as for subsequent reproduction of a job set.

Another, different, means and method of separating the print jobs of different users of a shared printer, without requiring banner sheets, is a "mailboxing" system, in which the different users jobs are placed in different bins, which can also be locked. Examples are disclosed in Xerox Corp. U.S. Pat. Nos. 5,328,169 issued Jul. 12, 1994, and 5,382,012 issued Jan. 17, 1995, to Barry P. Mandel. While desirable and advantageous, such a "mailboxing" system requires multi-bin sorter-like additional hardware and software, for an additional expense, and can complicate on-line finishing.

On line and/or output folding of sheets, per se, folded in "C" folders, of which one form is also called a "roof", "signature" or "saddle" folder, or folded in "Z" folders, is of course well known per se, and need not be redescribed in detail herein. Some examples of patents on such sheet folders in connection with copiers or printers include Xerox Corp. U.S. Pat. Nos. 5,377,965; 5,207,412, other art cited therein, and U.S. Pat. No. 5,076,556; and Eastman Kodak U.S. Pat. No. 5,108,082.

Of particular interest, it is also known to provide the print jobs output of a printer stacked horizontally with horizontal offsetting between jobs, in removable boxes or containers, and to do so on an elevator stacking platform maintaining a relatively constant stacking level. E.g., Xerox Corp. U.S. Pat. No. 5,172,904 issued Dec. 22, 1992 to C. Sze, et al; and U.S. Pat. No. 5,390,907 issued Feb. 21, 1995 to Otto R. Dole.

A specific feature of the specific embodiments disclosed herein is to provide a reproduction system in which a printer outputs a plurality of different plural sheet print jobs to a common print jobs stacking output, which print jobs are printed on copy sheets fed from a paper feed source of said reproduction system and fed to said common print jobs stacking output, the improvement comprising a system for automatically separating respective said print jobs into separate folders in an inclined but substantially vertically positioned plural print jobs container by loading folder paper stock into a said paper source for said same reproduction system, automatically feeding said folder paper stock from said paper source to said same print jobs stacking output in the correct sequence with said feeding of copy sheets for said print jobs to said print jobs stacking output, automatically inserting the said copy sheets of a respective print job into a respective open folder of said folder paper stock, and then closing said open folder around said print job to substantially enclose said print job within said folder, and inserting said closed folder with said print job substantially enclosed therein into said plural print jobs container, wherein at least one minor portion of said folder stock is offset from said copy sheets of said enclosed print job in said folder to define a projecting folder tab, and then repeating said process for subsequent folders and their respective substantially enclosed print jobs, and placing plural said enclosed print jobs in said substantially vertically positioned plural print jobs container with said projecting folder tabs extending vertically above said enclosed print jobs to provide clear distinctions and separations of respective print jobs between respective folders and so that a selected said print job can be readily removed as a unit within a folder from other said print jobs.

Further specific features disclosed herein, individually or in combination, include those wherein at least one minor portion of said folder stock is automatically formed to be maintained offset from said copy sheets of said enclosed print job in said folder to form said projecting folder tab by automatically folding said folder stock with an angularly skewed fold so that a corner thereof extends from said print job copy sheets even when said folder with said enclosed print job is substantially vertically oriented in said substantially vertically positioned plural print jobs container; and/or wherein said at least one minor portion of said folder stock is automatically formed to be maintained offset from said copy sheets of said enclosed print job in said folder to form said projecting folder tab by automatically folding over a corner of said folder stock so that said folded corner will engage the copy sheet of said enclosed print job and prevent said folder stock from sliding down relative to said enclosed print job when said folder with said enclosed print job is substantially vertically oriented in said substantially vertically positioned plural print jobs container; and/or wherein said substantially vertically positioned plural print jobs container has an angled bottom surface which tilts said container and said plural print jobs therein when said container is placed on a horizontal surface; and/or wherein said projecting folder tab is printed in said reproduction system with print job identifying indicia exposed in said container.

The disclosed systems may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, such control systems or methods may be implemented partially or fully in hardware, using standard logic circuits or single chip VLSI designs.

It is well known that the control of copy sheet handling systems may be accomplished by conventionally actuating them with signals from a microprocessor controller directly or indirectly in response to simple programmed commands, and/or from selected actuation or non-actuation of conventional switch inputs such as switches selecting the number of copies to be made in that job or run, selecting simplex or duplex copying, selecting a copy sheet supply tray, etc. The resultant controller signals may conventionally actuate various conventional electrical solenoid or cam-controlled sheet deflector fingers, motors or clutches, or other components, in programmed steps or sequences. Conventional sheet path sensors or switches connected to the controller may be utilized for sensing, counting, and timing the positions of sheets in the sheet paths of the reproduction apparatus, and thereby also controlling the operation of sheet feeders and inverters, etc., as is well known in the art, and need not be redescribed herein.

In the description herein the term "sheet" refers to a usually flimsy physical sheet of paper, plastic, or other suitable physical substrate for images, whether precut or web fed. A "copy sheet" may be abbreviated as a "copy", or called a "hardcopy". A "job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Figure 2:
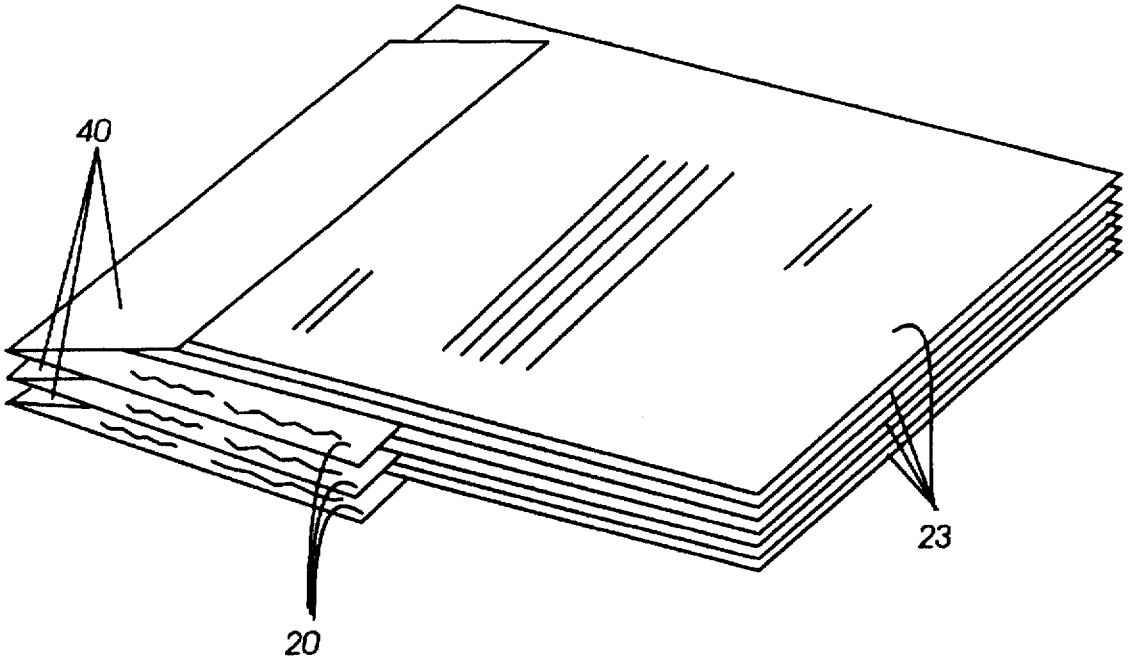
Figure 3:
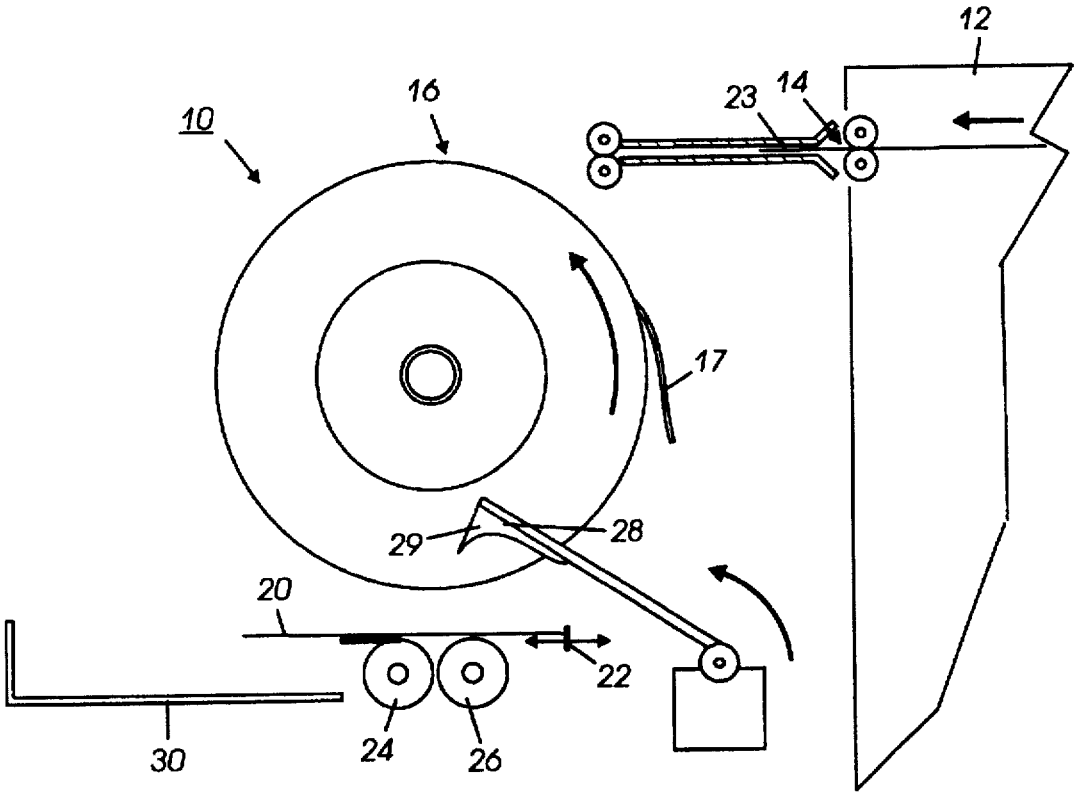
Figure 4:
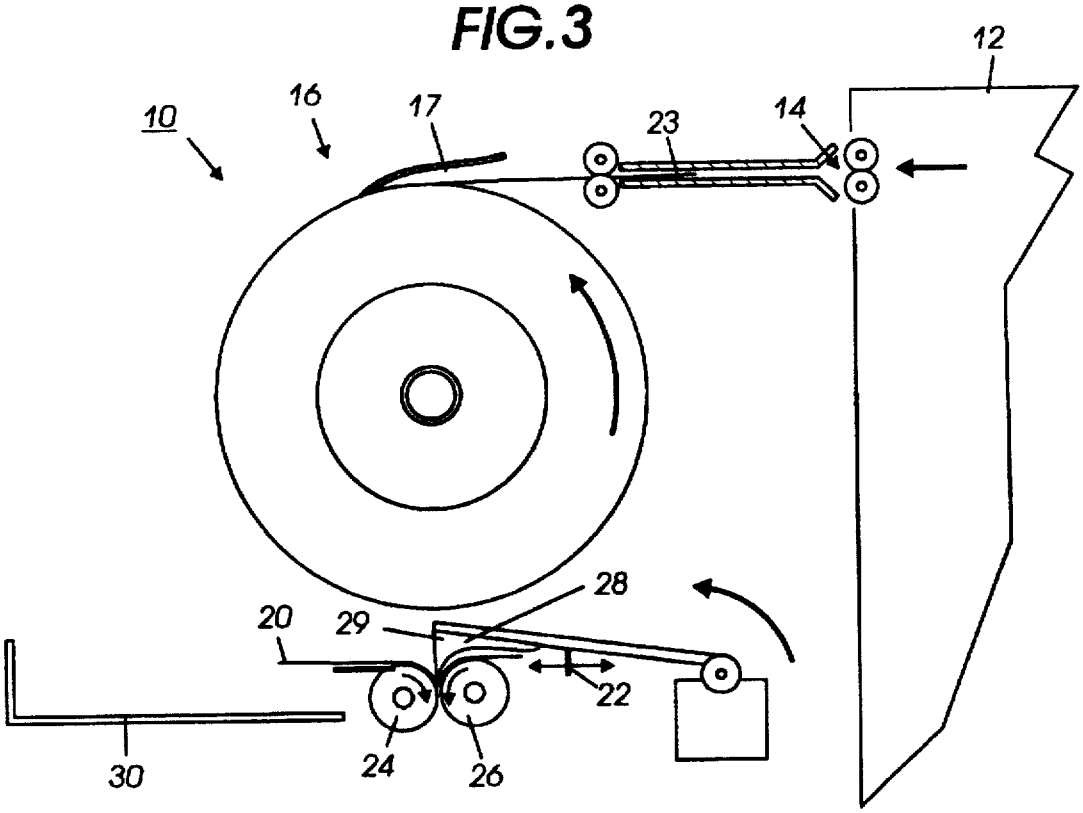
Figure 5:
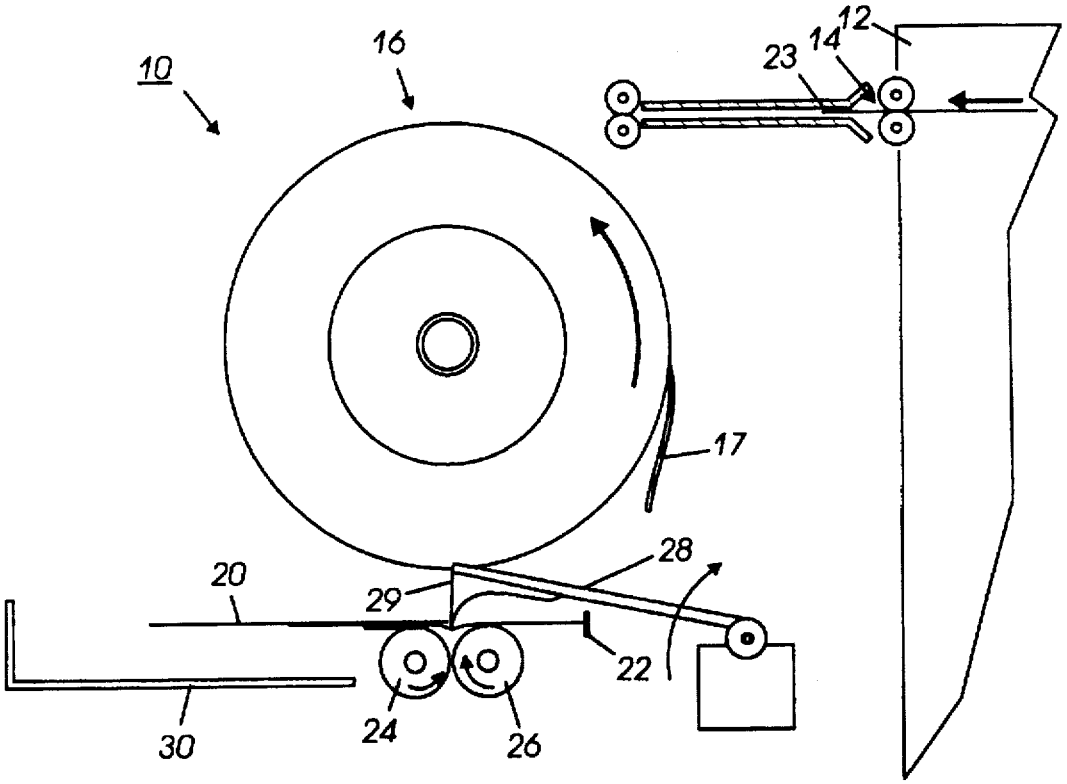
Figure 6:
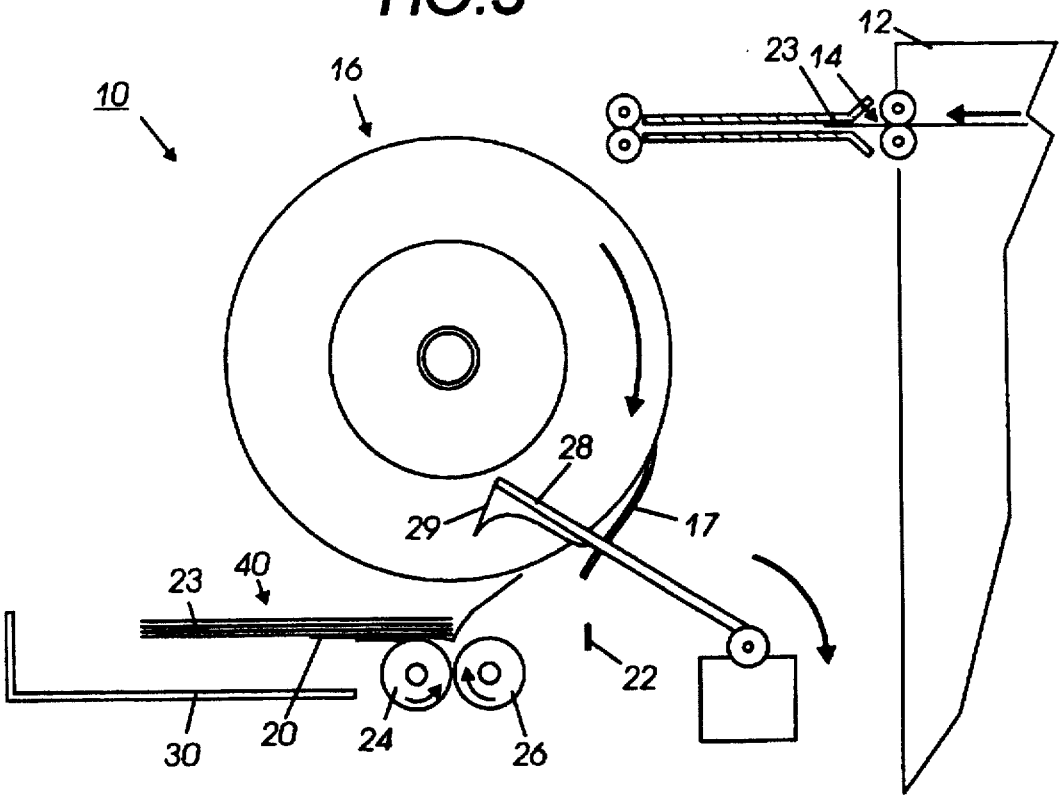
Figure 7:
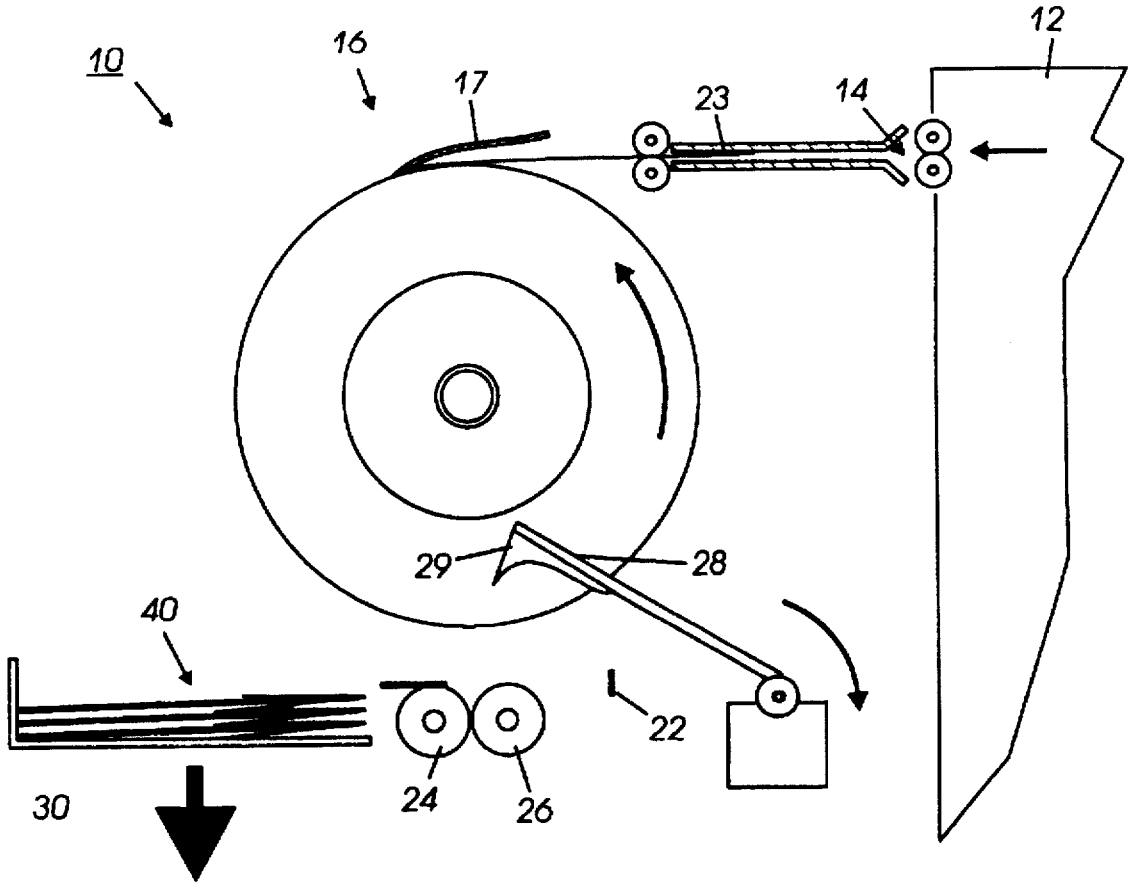
Figure 8:
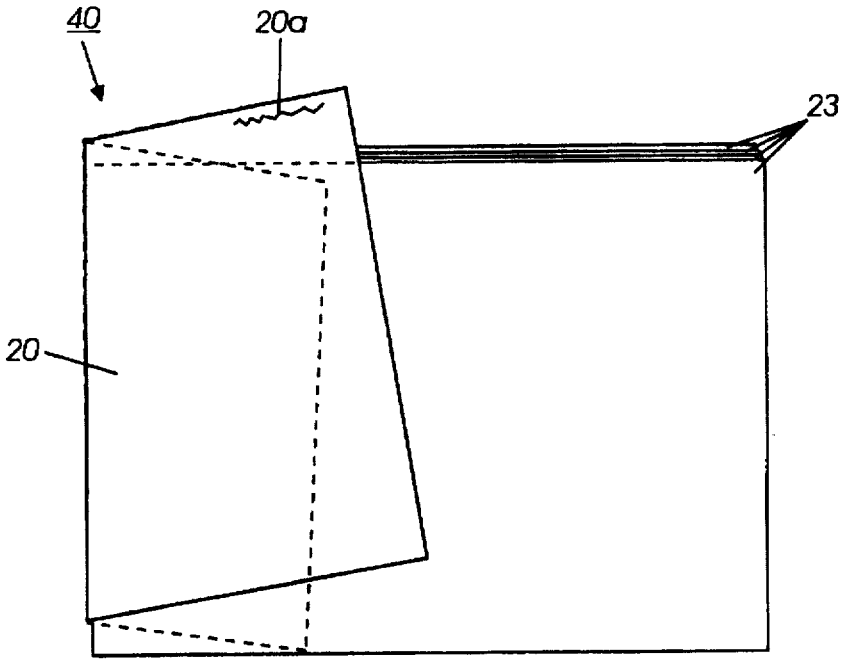
Figure 13:
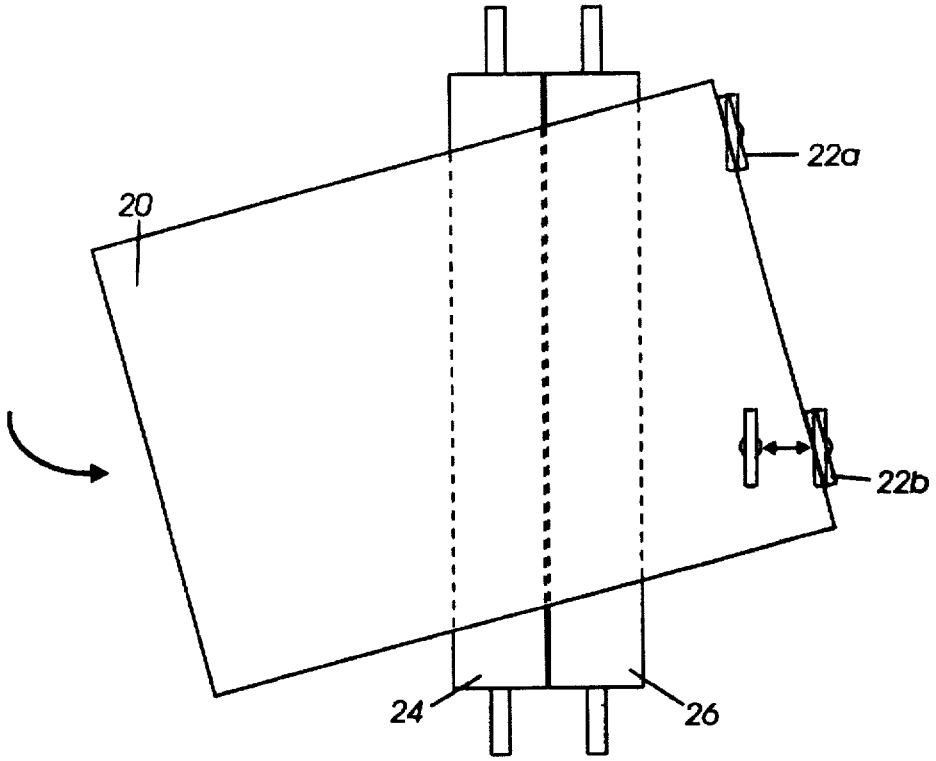
Figure 9:
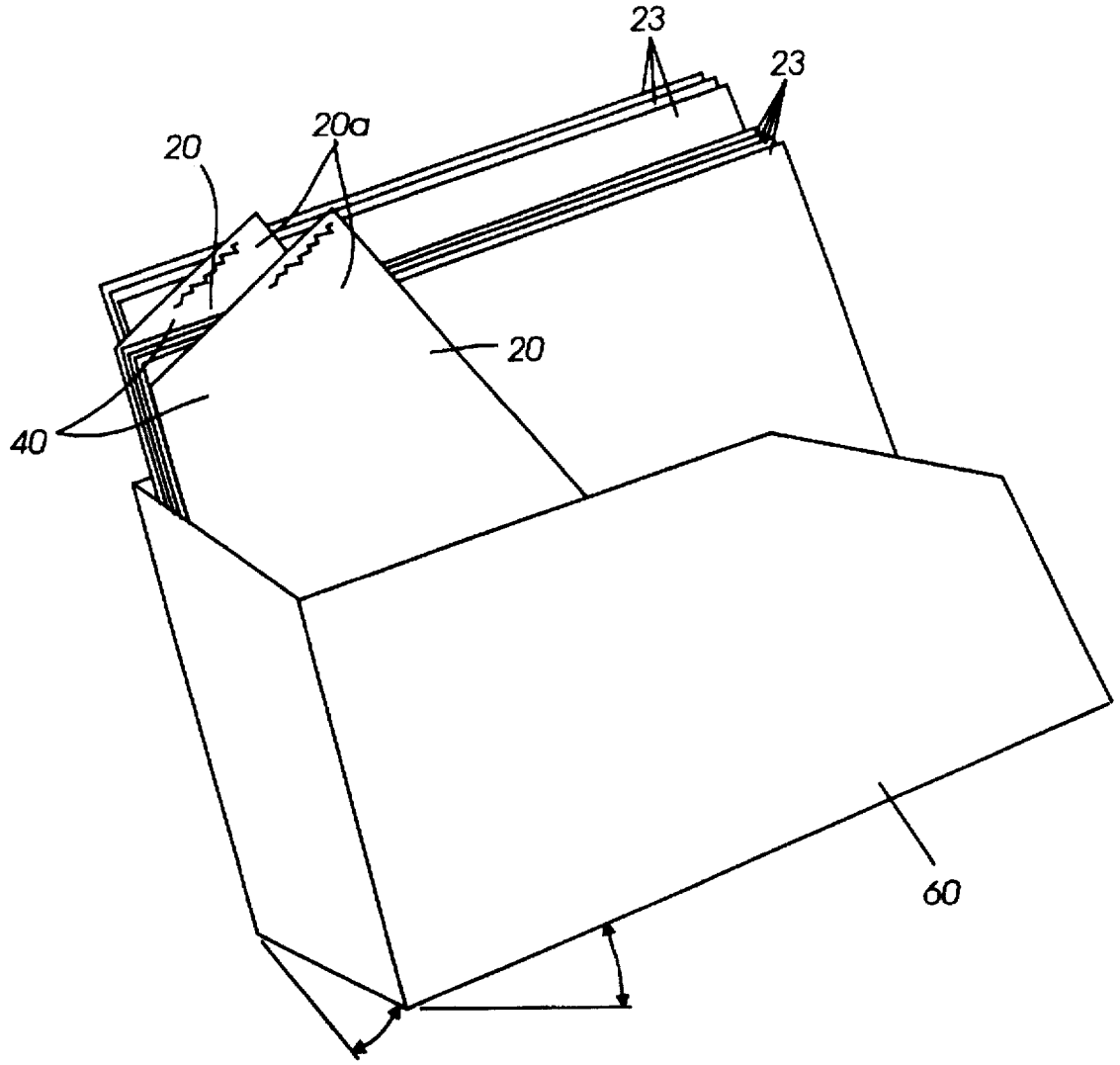
Figure 10:
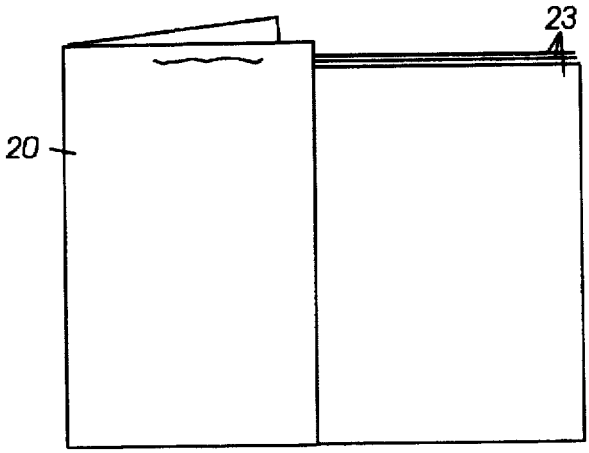
Figure 11:
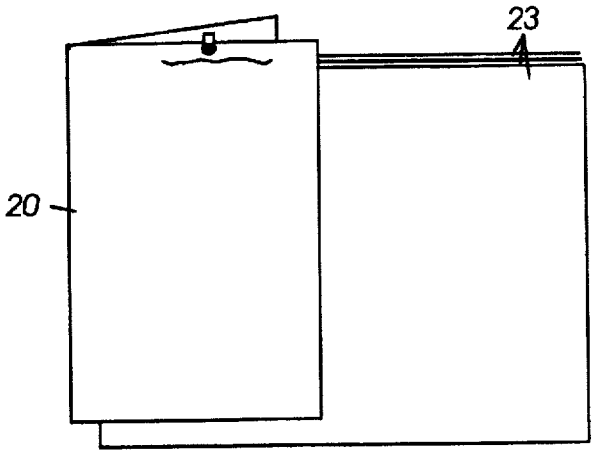
Figure 12:
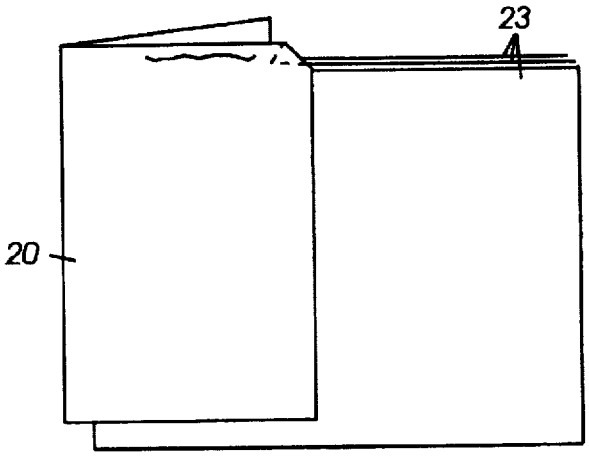
Figure 14:
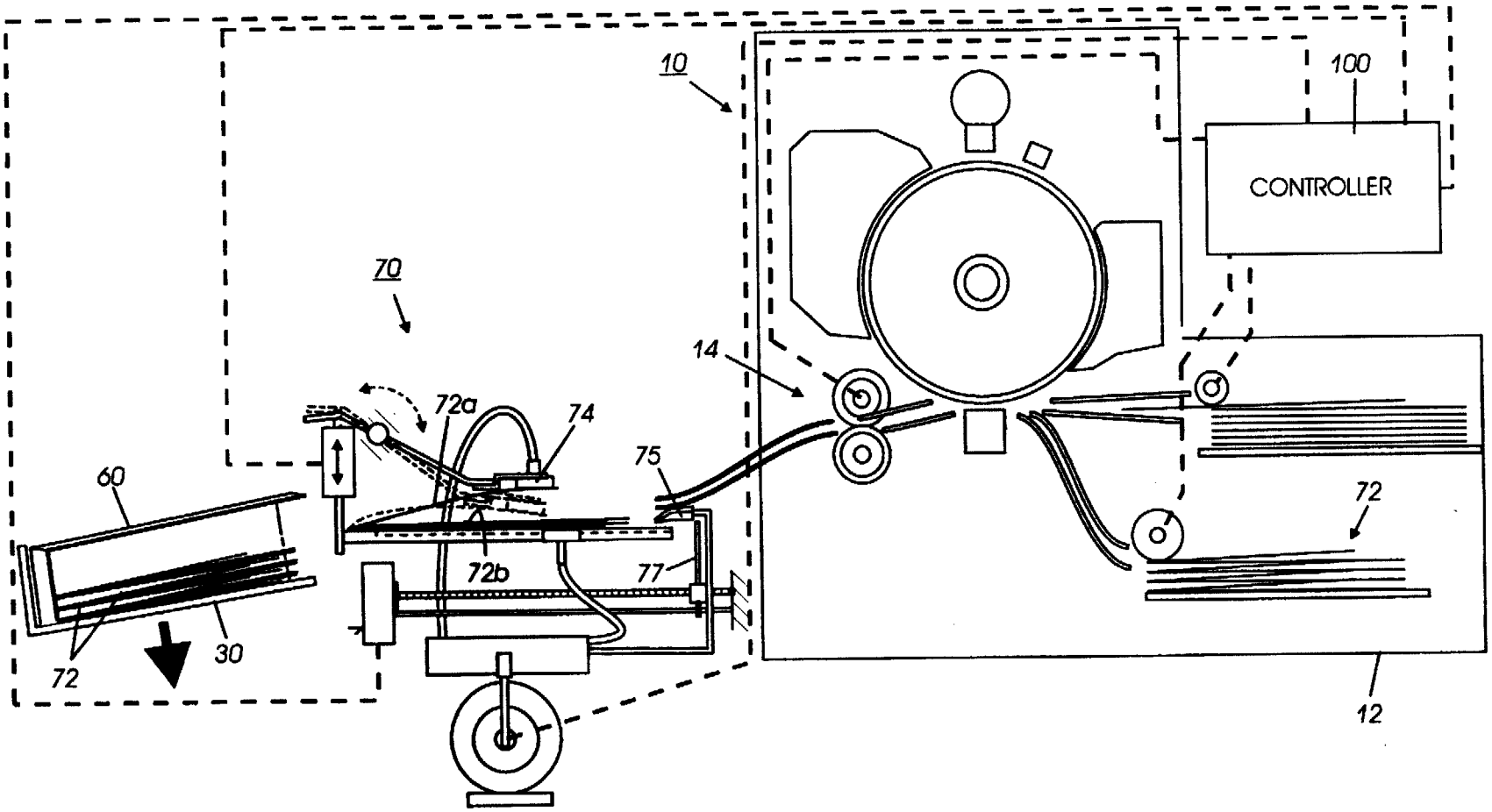

Various of the above-mentioned and further features and advantages will be apparent from the specific apparatus and its operation described in the examples below, and the claims. Thus, the present invention will be better understood from this description of specific embodiments, including the drawing figures (approximately to scale) wherein:

FIG. 1 is a frontal perspective view of one example of a conventional printer with plural selectable copy sheet paper input trays and an output of plural print jobs of plural sheets respectively held in separate print job folders, in one example of the subject automatically generated print job folders;

FIG. 2 is a perspective top view of one example of an output stack per se of three individual print jobs in three identical exemplary individual print job folders in accordance with the present system in which the folders here are laterally offset from their contained print jobs to form respective exposed edges providing exposed tab areas on which discrete print job identifying indicia can be printed for each enclosed print job, as shown;

FIGS. 3–7 show sequential operating positions of an otherwise identical frontal schematic view of one example of an output system for automatically registering, folding, filling an outputting print job containing folders in accordance with the present system, wherein: in FIG. 3 a print job sheet is shown above being outputted from a conventional printer as in FIG. 1 to an otherwise conventional disk stacker, while a previously outputted folder stock sheet has already been placed by the disk stacker with its lead edge against a registration edge and overlying a folding rollers pair; in FIG. 4 a folding knife is lowered onto the folder sheet to insert that sheet into the rotating folding rolls nip to fold it; in FIG. 5 the folding rolls are reversed to bring up the folder sheet there and the folding knife is held thereon with the front edge of the folding knife now functioning as a different registration edge or set stop for the front edge of the print job sheets which are being placed by the disk stacker on top of the outer portion of the folder sheet, front edge registered with the fold line; in FIG. 6 the folding knife is lifted and the disk stacker reversed so that its fingers will catch and fold over the inner portion of the folder sheet and then push the folder with its job set out onto the output tray; and in FIG. 7 that job set within its folded folder is shown stacked on top of prior sets stacked in the output tray while the next folder sheet is shown being inputted to the disk stacker entrance;

FIG. 8 shows a different, skew-folded, individual filled print job folder, per se, in accordance with the present system, with an edge portion of the folder formed to be held above or outside of the print job held in the folder, even in a substantially vertical position thereof, by the oppositely projecting corners of the skewed fold folder;

FIG. 9 is a perspective view of one example of the subject print job container box (or storage rack portion) in which substantially vertical plural print jobs within print job folders partially extend vertically from their print jobs for ease of identification and separation; in this case, folders in accordance with FIG. 8; wherein both axes of the container bottom are angled from the normal horizontal plane surface on which the container may be placed, as shown by the angle lines and arrows, so as to increase the offsetting display of the separate print job containing and labeled folders therein, by said angled bottom surface tilting said container and said plural print jobs therein as shown when said container rack bottom is placed on a horizontal surface;

FIGS. 10 through 12 are three similarly frontal or perspective views of three individual print jobs in three somewhat different substantially vertical individual print job folders, per se, also usable in the container of FIG. 9; with an edge portion of the folder held above the print job, and prevented from sliding down, even in this substantially vertical position, respectively, by, in FIG. 10, a folder having a different lateral folder sheet stock dimension than the print job sheets, by, in FIG. 11, a semi-perforated or stapleless staple or other projecting tab formed adjacent the top edge of the folder sheet, and by, in FIG. 12*a*, a folded over corner or "dog ear" in one corner of the folder sheet stock;

FIG. 13 is a partial top view of a variant of the exemplary system of FIGS. 3–7 as one example of a system for producing skewed folders as shown in FIGS. 8 and 9 by skewing the folder sheet registration edge before folding it by having the registration fingers skewed relative to one another by being at different distances downstream in the sheet movement direction;

and FIG. 14 schematically shows in a frontal view an alternative system for opening, filling, closing and stacking a preformed, prefolded, folder with a print job into the special container of FIG. 9.

Referring first to FIGS. 1 and 3 through 7 in particular, and their above descriptions, they illustrate schematically one of many possible examples of an automatic system 10 for outputting print jobs in folders in accordance with the concepts herein. The output of any conventional or other printer 12 (shown in FIG. 1) is sequential sheets at the printer 12 output 14. The printer 12 operation, including sheet feeding and printing and sequencing, is conventionally controlled by its software programmable controller 100. In this example of FIGS. 3–7, these sheets are fed into this exemplary print job folder filling system 10 by feeding them sequentially from the printer output 14 into an otherwise conventional rotating disk inverter/stacker 16 having conventional sheet holding slots formed by fingers 17 on the disks peripheries. This disk stacker 16 may be, for example, like that further described in Xerox Corp. U.S. Pat. No. 5,409,202 issued Apr. 25, 1995 to Naramore and Kramer. (A disk stacker system is not required however.)

Here in this exemplary system 10, however, the sheet which is outputted first into the disk stacker 16 is not a print job copy sheet 23, it is a folder stock banner sheet 20, which may be fed from a selected paper feed tray such as 15*a* in the printer 12 which is different from, and alternatively fed from, the other selected paper feed trays 15*b*, 15*c*, etc., from which the print job sheets 23 will be fed.

As shown in the sequence of FIGS. 3–7, and already briefly described in their figure descriptions above, this first, folder sheet, 20 is conventionally carried around and inverted in the disk stacker 16 and released from the fingers 17 of the disks registered against a substantially underlying registration edge 22 positioned so that the sheet 20 is now overlying a conventional pair of sheet folding rolls 24 and 26, as in FIG. 3. At that point, as in FIG. 4, a conventional sheet folding inserter knife 28 is brought down to cause the folder sheet 20 to be conventionally folded down between the rolls 24 and 26 which are driven for that purpose as shown by their movement arrows. As shown in FIG. 5, with reverse movement arrows, the rolls 24 and 26 may then reverse and the knife 28 positioned so that the now creased folder sheet 20 is lying open and ready to receive job sheets 23 stacked thereon, and the front edge 29 of the folding knife 28 will serve as a sheet registration edge and disk sheet stripping off member. Thus, in this position, the subsequently outputted sheets, the print job sheets 23, will be neatly stacked by the disk stacker 16 with one edge aligned with the fold or crease line previously made in the folder sheet 20. As shown, the extending portions of the folder sheet 20 and the print job sheets 23 may be supported on the directly adjacent conventional catch or stacking tray 30.

As shown in FIG. 6, once all the plural sheets 23 of that particular print job for that particular folder 20 have been stacked onto that folder, the knife 28 is lifted out of the way and the disk stacker 16 may be briefly reversed in rotation as shown by its movement arrow so that the finger 17 catches the previously registered end of the folder sheet 20 and flips it out over the tray 30, which causes that top side end of the folder sheet 20 to close over the job sheets 23, thereby enclosing the job sheets 23 in a completed folder set 40, and ejecting the folder set 40 out onto the tray 30, or onto any prior such sets 40, to form a stack thereof in which the job sets are clearly and unmistakably physically separated from one another. The above process is then repeated by printing (if desired), print job filling, folding and outputting another such folder sheet 20 with its print job separately confined therein in its automatically generated folder.

The tray 30 is conventionally held at the correct height as it fills relative to the disk stacker output by a conventional tray elevator system, as described in the above and other patents, schematically shown here by the movement arrow under the tray. Thus, the top sheet in the tray 30 is maintained approximately at the level of the top of the rollers 24 and 26 here. A container 60 such as that of FIG. 9 may be placed in tray 30, as shown in FIG. 14, and thus automatically filled. Or, the tray 60 may comprise a stacked or integral set of plural containers 60 forming a multifunction mailbox rack or bin set.

As disclosed in FIGS. 8 and 9, and 13, it may be desirable to intermediately fold the folder sheet 20 at an angle rather than with a normal fold, perpendicular to its edges, so that its edges after folding are angularly skewed so that at least one corner thereof extends from the print job sheets therein, as shown in the print job containing folder unit example 40 of FIG. 8 per se and as shown in the two such sets 40 in FIG. 9 loaded and held in a special output container or rack unit 60. This modified folder 40 can be provided, for example, as shown in the partial top view of FIG. 13, by skewing the registration edge 22 by having the fingers **22*a* and 22*b* at different distances downstream in the sheet movement direction, such as by permanently or temporarily moving one of the fingers, 22*b* here, away from an aligned position with finger 22*a*. The knife and rollers or other folding system may be the same. Once folded, as shown in FIG. 8 the two ends of the two sides of the folder will be oppositely laterally offset from one another and from the square stacked print job sheets therein by the amount of this skew induced before folding even if the folder sheet 20 is of the same lateral dimensions as the print job sheets. This forms a projecting tab area 20*a*** with exposed printing without requiring tab cutting or oversized sheets. This folder is self-standing above its contained print jobs even when placed vertically because the skewed folding increases its top to bottom dimensions by more than its normal width or length.

The self-generating banner sheet folder may be from normal copy paper stock, or heavier than normal paper stock. It may also be from slightly larger sheets such as A4, as in FIG. 10, or much larger sheets, for forming full size or fully enclosing folders, such as conventional 11" by 17" sheets. If such considerably larger sheets are desired for the folders, it is well known that such large sheets can be fed and printed short edge first and then rotated 90 degrees, so as not to require a wider printer even if the regular size sheets of the print job are fed through the printer and printed long edge first, as is conventional for maximum printing speed. Patents and publications on sheet rotation include those cited in Xerox Corp. U.S. Pat. No. 5,342,034 especially starting at the bottom of Col. 22. Although the folder stock could be fed from the same paper tray, and be the same as, the print job stock, other than for its folding, set enclosing, tab printing and/or other differences, it is preferable that the folder stock be of a different weight, size, material, printing and/or color to provide additional distinctions between the folders and their print job contents. By repositioning the registration edge 22, illustrated by the FIG. 4 movement arrow, the defined fold line position of the folder sheet 20 can be easily changed. This can allow the two sides of the folder to vary in height from one another.

As noted in the cited and other art, generation of printed banner sheets is a relatively simple matter using existing technology, and is already commonly provided in printers for print job banner sheets. The banner sheets may be generated on-line or on the fly by a signal from the printer controller 100 (which will normally also retain the print job identification information). The format of the job, and a print form for the banner, may be stored in machine memory as a form, as is well known. The specific job description information can be automatically inserted into the form template, as is also well known. Patents on details of exemplary electronic printer forms generation include U.S. Pat. No. 4,903,229 to Schmitt, et al (Pitney Bowes), and Xerox Corp. GB 2 198566A, published Jun. 15, 1988. As is well-known, a stored cover (banner) sheet form can also include graphic and/or background patterns so that a banner sheet can be clearly distinguishable from a document sheet when printed. E.g., the banner sheets generated for each print job by the Xerox Corp. "2700" and many other well know electronic printers.

It is known to load and print prefolded and tabbed simple paper or card stock "C" folders in a copier or printer, and to print the tabs thereof. E.g., Xerox Corp. U.S. Pat. No. 4,974,035 issued Nov. 27, 1990 and Eastman Kodak EPO No. 0 208 324 published Jan. 14, 1987. On-line tab-cutting of folder stock in the printer or copier is also known, in Xerox Corp. U.S. Pat. No. 4,819,021 issued Apr. 4, 1989 to M. S. Doery. Thus, an alternative system 70 as in FIG. 14 may employ prefolded folders 72 (optionally also having precut tabs). The folders 72 may be loaded into one of the paper feed trays of a printer, or an interposer feed tray, and fed out on controller 100 command for the tab and or body of the folder to be conventionally printed as per art cited above or otherwise with banner information such as a print job title and/or printer user identifier, and then fed on to the output area 14 of the printer 12, into a compiling and filling area, which may or may not be partially or fully on top of the output tray 30, or the existing stack of folders 72, in the tray 30. As shown in FIG. 14, in the output tray 30, in this embodiment 70, the top half **72*a* of such a folder can be temporarily lifted and held open relative to the bottom half 72*b* of the folder 72, such as by a conventional friction wheel, vacuum separator or suction cup lifter 74, which separation may be assisted by a known "air knife" 75, while the respective print job sheets are printed and fed into this now-opened folder 72. Then, the folder top half 72*a* can be closed down by dropping or reversing the lifter 74, or by applying a conventional set separator or hold-down finger, such as that shown in, e.g., U.S. Pat. No. 4,589,645 and other art cited therein. Then, that filled and closed folder 72 may be ejected fully out onto the tray 30 by a movable ejector finger or wall 77, if not already so positioned, and the next empty folder 72 may be fed into the compiling and filling position, opened and filled in the same manner and then likewise fed out on top of this previously filled folder 72. Additionally shown in FIG. 14 is one example of the special container 60, as in FIG. 9, in the tray 30 being automatically loaded with a number of print jobs within folders. As another or additional alternative, the prefolded folder 72 may have a rear corner folded over or "dog eared", as in FIG. 12**, to make the folder easier to open for receiving the print job sheets therein.

As to this alternative system 70 however, it will be appreciated that preformed, prefolded, folders must be special ordered and stored, and are much more expensive, and harder to feed and print in a xerographic printer or copier, than ordinary and available unfolded single layer paper sheet stock. Thus, it will be appreciated that features of disclosed folder opening, filling, ejection and container filling system of FIG. 14 may also be employed in connection with various on-line folding apparatus fed unfolded folder stock as in other embodiments above.

While the embodiments disclosed herein are preferred, it will be appreciated from this teaching that various alternatives, modifications, variations or improvements therein may be made by those skilled in the art, which are intended to be encompassed by the following claims:

We claim:

1. In a reproduction system in which a printer outputs a plurality of different plural sheet print jobs to a common print jobs stacking output, which print jobs are printed on copy sheets fed from a paper feed source of said reproduction system and fed to said common print jobs stacking output, the improvement comprising a system for automatically separating respective said print jobs into separate folders in an inclined but substantially vertically positioned plural print jobs container by loading folder paper stock into a said paper source for said same reproduction system, automatically feeding said folder paper stock from said paper source to said same print jobs stacking output in the correct sequence with said feeding of copy sheets for said print jobs to said print jobs stacking output, automatically inserting the said copy sheets of a respective print job into a respective open folder of said folder paper stock, and then closing said open folder around said print job to substantially enclose said print job within said folder, and inserting said closed folder with said print job substantially enclosed therein into said plural print jobs container, wherein at least one minor portion of said folder stock is offset from said copy sheets of said enclosed print job in said folder to define a projecting folder tab, and then repeating said process for subsequent folders and their respective substantially enclosed print jobs, and placing plural said enclosed print jobs in said substantially vertically positioned plural print jobs container with said projecting folder tabs extending vertically above said enclosed print jobs to provide clear distinctions and separations of respective print jobs between respective folders and so that a selected said print job can be readily removed as a unit within a folder from other said print jobs.

2. The reproduction system with a system for automatically separating respective said print jobs into separate folders in an inclined but substantially vertically positioned plural print jobs container of claim 1, wherein said at least one minor portion of said folder stock is automatically formed to be maintained offset from said copy sheets of said enclosed print job in said folder to form said projecting folder tab by automatically folding said folder stock with an angularly skewed fold so that a corner thereof extends from said print job copy sheets even when said folder with said enclosed print job is substantially vertically oriented in said substantially vertically positioned plural print jobs container.

3. The reproduction system with a system for automatically separating respective said print jobs into separate folders in an inclined but substantially vertically positioned plural print jobs container of claim 1, wherein said at least one minor portion of said folder stock is automatically formed to be maintained offset from said copy sheets of said enclosed print job in said folder to form said projecting folder tab by automatically folding over a corner of said folder stock so that said folded corner will engage the copy sheet of said enclosed print job and prevent said folder stock from sliding down relative to said enclosed print job when said folder with said enclosed print job is substantially vertically oriented in said substantially vertically positioned plural print jobs container.

4. The reproduction system with a system for automatically separating respective said print jobs into separate folders in an inclined but substantially vertically positioned plural print jobs container of claim 1, wherein said substantially vertically positioned plural print jobs container has an angled bottom surface which tilts said container and said plural print jobs therein when said container is placed on a horizontal surface.

5. The reproduction system with a system for automatically separating respective said print jobs into separate folders in an inclined but substantially vertically positioned plural print jobs container of claim 1, wherein said projecting folder tab is printed in said reproduction system with print job identifying indicia exposed in said container.

* * * * *